United States Patent [19]

Eusner

[11] 4,377,978

[45] Mar. 29, 1983

[54] FIRING SYSTEM AND BURNER FOR ROTARY KILN

[75] Inventor: Paul R. Eusner, Wellsley Hills, Mass.

[73] Assignee: Mullite Company of America, Andersonville, Ga.

[21] Appl. No.: 298,863

[22] Filed: Sep. 3, 1981

[51] Int. Cl.[3] ..... F23K 5/00

[52] U.S. Cl. ..... 110/262; 110/264; 110/265; 432/105

[58] Field of Search ..... 110/261, 262, 260, 263–265; 432/105

[56] References Cited

U.S. PATENT DOCUMENTS

| | | | |
|---|---|---|---|
| 1,953,090 | 4/1934 | Vroom | 110/262 |
| 2,301,017 | 11/1942 | Cherry | 110/261 |
| 3,115,851 | 12/1963 | Ceely | 110/261 |
| 3,147,795 | 9/1964 | Livingston et al. | 110/261 |
| 4,032,287 | 6/1977 | Blum et al. | 110/262 |
| 4,206,712 | 6/1980 | Vatsky | 110/261 |
| 4,321,034 | 3/1982 | Taccone | 110/261 |

FOREIGN PATENT DOCUMENTS

| | | | |
|---|---|---|---|
| 2905746 | 8/1980 | Fed. Rep. of Germany | 110/262 |
| 649680 | 12/1928 | France | 110/262 |
| 819133 | 8/1959 | United Kingdom | 110/262 |
| 885376 | 12/1961 | United Kingdom | 110/262 |

*Primary Examiner*—Henry C. Yuen

[57] ABSTRACT

A rotary kiln (16) fired with pulverized coal as the primary fuel with the firing system including a burner (22) capable of utilizing coal, gas or oil. The firing system and burner are such as to provide particular ratio of burner discharge area to primary air flow for coal firing so as not to contaminate the kiln product during coal firing operation.

1 Claim, 5 Drawing Figures

FIRING SYSTEM AND BURNER FOR ROTARY KILN

BACKGROUND OF THE INVENTION

The operation of rotary kilns for the heat processing of various particulate materials, such as kaolin and bauxite to produce mullite, is extremely energy intensive. In order to have a satisfactorily operating kiln, it is necessary that the kiln first be brought up to temperature and then be operated continuously for long periods of time at the prescribed temperature. It is the general practice to fire the kilns by means of a burner disposed at the material discharge end of the kiln to project fuel and air generally coaxial of the kiln so as to provide an intense flame in the kiln to generate the required high temperature. The primary fuel generally employed is natural gas with oil also being utilized. Additionally, minor amounts of pulverized coal have been employed. However, it is necessary that the burner and firing system be such that the product passing down through the kiln is in no way contaminated with coal firing providing a problem in this respect. Because of the large amount of fuel required in the continuous operation of a kiln, the cost with respect to the primary fuel is a very important consideration. The utilization of gas and oil results in a very high kiln operating cost.

BRIEF DESCRIPTION OF THE INVENTION

The present invention provides a burner and firing system especially designed for the continuous utilization of pulverized coal as the primary fuel in the operation of a rotary kiln. The burner additionally has the capability of alternate or simultaneous use of coal and natural gas or of the alternate and simultaneous use of oil and natural gas. The burner and firing system utilizes a coal pipe that is supplied with primary air and pulverized coal with the ratio of the discharge opening of the burner to the volume rate of flow of the primary air being such that the flame produced when the pulverized coal is maintained well away from the end of the burner and is of such a configuration that the product transversing the kiln is not contaminated by ash. The ash passes up through the kiln and out the stack at the upper end of the kiln and does not deposit on, discolor or otherwise contaminate the product. An annular chamber is formed about the coal pipe with secondary air being supplied to this chamber. Also, located in this chamber are a plurality of gas fuel pipes axially parallel with the coal pipe and uniformly positioned about the same. A suitable manifold and distribution pipes or connectors are effective to connect these gas pipes to a source of supply. It is desired that both the primary air stream and the secondary air stream be as non-turbulent and as close to laminar flow as possible and with respect to the latter straightening vanes are provided in the secondary air annulus near the discharge end of the coal pipe. There is provided an oil gun which may be readily inserted and removed from the coal pipe when it is desired to substitute oil firing for coal firing with this gun having suitable support means so that when positioned in the coal pipe it is mounted generally coaxially of the pipe.

DETAILED DESCRIPTION OF THE PREFERRED EMBODIMENT

Figure 1:
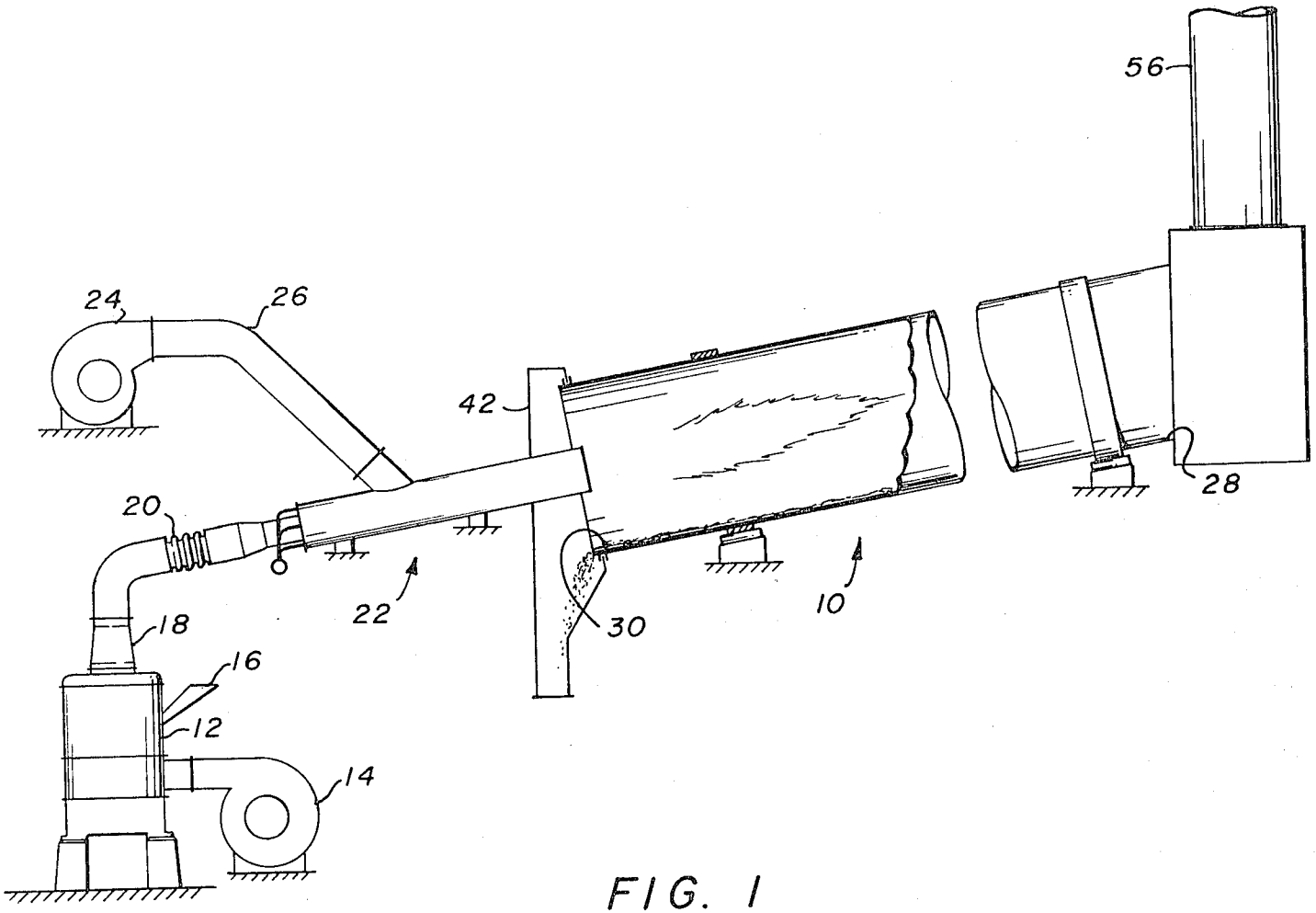
FIG. 1 is a diagrammatic view partially broken away showing the rotary kiln and the firing system of the invention.

Referring now to the drawings wherein like reference characters are used throughout to designate like elements, there is depicted, particularly in FIG. 1, a rotary kiln and firing system with the rotary kiln being designated generally 10 and with the kiln as illustrated being fired by pulverized coal. For this purpose, there is provided an air swept pulverizer 12 supplied with air by the primary air fan 14 and supplied with coal at 16 from a suitable feeder (not shown). The pulverized coal entrained in the primary air stream passes out the mill discharge conduit 18 thence through the flexible hose 20 to the burner designated generally 22. This burner is supplied with secondary air by means of the secondary air fan 24 which is connected by a duct 26 to the burner.

The burner supplies fuel to the kiln 10 for the treatment of suitable particulate material that is supplied to the kiln at the upper end 28 and is discharged from the kiln at the lower end 30 passing down through the kiln as it is relatively slowly rotated about its axis. Illustrative of the material that may be processed in the kiln is kaolin or bauxite which is fed to the kiln in particulate form by means of a continuous feed mechanism and is transformed during its passage through the kiln to primary phase mullite with this particulate mullite being discharged from the lower end of the kiln and transported to a suitable collecting warehouse. This finished mullite product has a substantial number of uses with it being primarily used in various refractories. In the processing through the kiln, it is necessary that the heat condition in the kiln be maintained within its proper range and that the material not be in any way contaminated by means of the fuel that is introduced into and burned within the kiln.

In accordance with the invention, the burner and firing system utilizes pulverized coal as the primary fuel for the kiln thereby very substantially reducing the fuel costs over that which would be incurred if either natural gas or oil were utilized as the primary fuel. The burner of the invention includes the coal pipe 32 that is coaxial with and mounted in the secondary air or blast pipe 34 by means of spider 35 and end plate 37. These two pipes are spaced from each other to form an annular secondary chamber 36 therebetween. The coal pipe 32 is supplied by primary air and pulverized coal by being connected to the flexible hose 20 via flanged connection 38 which is readily disassembled so that access can be had to the coal pipe 32. The secondary air chamber 36 is connected to the secondary air duct 32 by means of the connector 40. The burner is mounted in the wall of the hood 42 positioned at the lower end of the kiln by means of the burner mounts 44.

Figure 3:
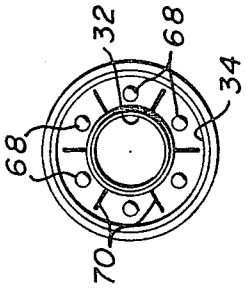
FIG. 3 is a sectional view taken along line 3—3 of FIG. 1.

Disposed about the coal pipe 32 are a plurality (6 being illustrated) of gas pipes 68 to supply natural gas as a fuel for the burner. These are uniformly positioned about the coal pipe as shown in FIG. 3 and are mounted thereon by means of suitable brackets 60 which are distributed along the pipes. These brackets may be welded both to the coal pipe and to the gas pipe. Fuel, such as natural gas, is supplied to the pipes 68 by means of the supply duct 62 which is connected to the manifold 64. This manifold is in turn connected by the distribution conduits 66 to the gas pipes 68. This fuel supply is controlled by valve 63.

Figure 4:
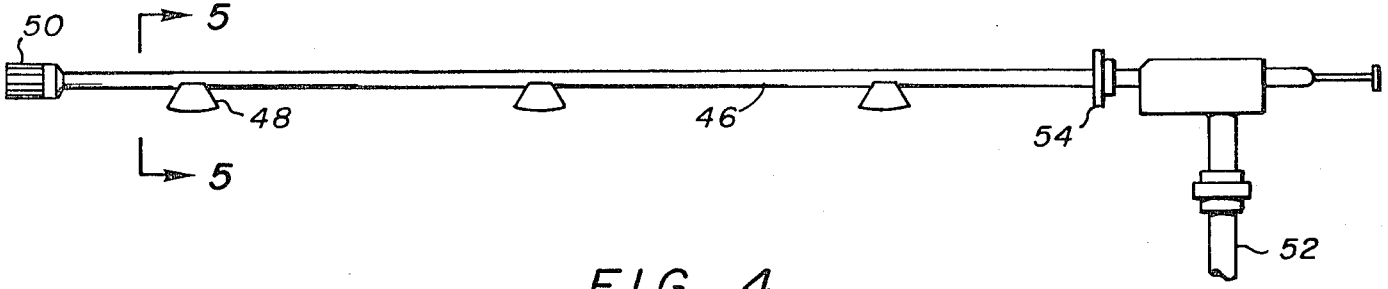
FIG. 4 is an elevational view of an oil gun that forms a part of the burner.
Figure 5:
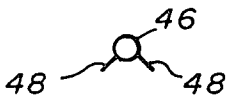
FIG. 5 is a sectional view taken generally along line 5—5 of FIG. 4.

There is additionally provided an oil gun 46 that can be mounted in the interior of the coal pipe 32 with the gun being provided with several pairs of supportlegs 48 distributed along its length as shown in FIGS. 4 and 5. The oil gun is positioned in the coal pipe by disconnecting the hose 20 from the pipe and then sliding the gun into the pipe so that its discharge nozzle 50 is located at the discharge end of the pipe. Oil is supplied to the gun by means of the supply hose 52 and a flange 54 forms a part of the gun with this flange cooperating with the flange 38 on the end of the coal pipe such that these flanges may be readily secured together when the gun is mounted in the coal pipe.

Thus, as can be seen with the burner of the invention, either pulverized coal firing or gas firing may be utilized and if desired these two fuels may be fired simultaneously. Likewise, oil or gas firing may be utilized either individually or simultaneously. However, the burner is particularly designed for sustained firing by pulverized coal as the primary fuel for the kiln.

One of the important features of this burner design is the ability to rapidly change from pulverized coal firing to natural gas firing so that costly disruptions of the operation of the kiln can be prevented whenever the fuel supply from the pulverizing equipment is disrupted. Upon termination of the pulverized coal supply, the gas supply may be quickly initiated as by the operation of the valve 63 so that this gaseous fuel will be supplied by the gas pipes 68 and the burner will be operated as a gas burner. This is an extremely valuable feature in the operation of the kiln from the cost standpoint.

In the operation of the burner in the pulverized coal firing mode, it is necessary that the flame be spaced well away from the end of the burner and be of a configuration so that the ash that is produced does not contaminate the product descending down through the kiln but rather passes up through the kiln and out the stack 56 to suitable collecting equipment before discharging the combustion gases to atmosphere. It has been found that to produce this desired result and to have satisfactory pulverized coal firing as the primary fuel source for the kiln that the primary air stream with the pulverized coal entrained therein and the secondary air stream should not be in a turbulent condition as discharged into the kiln. Moreover, it has also been found that the velocity of the primary air discharging from the end of the coal pipe must be within relatively closely regulated limits. In this regard, it is necessary that the ratio of the discharge opening 58 of the coal pipe to the volume rate of supply of the primary air be approximately 1 to 340 with the area of opening 58 being in square feet and the primary air flow being in cubic feet per second. This ensures a discharge velocity of approximately 350 feet per second. With this arrangement, satisfactory pulverized coal firing is obtained such that coal can be used as the primary fuel for the kiln and the product produced by the kiln is eminently satisfactory.

Figure 2:
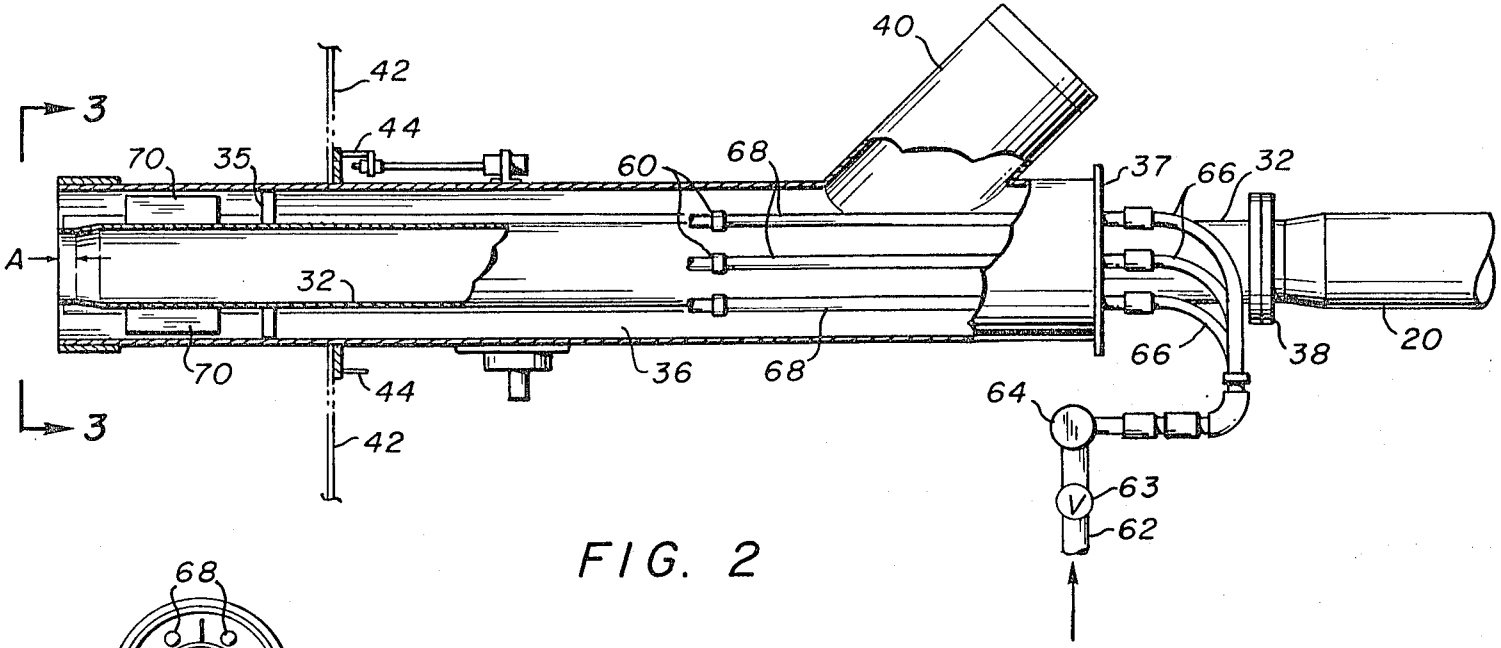
FIG. 2 is a side view of the burner partially in section.

In order that primary air flow will be substantially non-turbulent as discharged from the end of the coal pipe 32 when this pipe is necked down as illustrated in FIG. 2, it is necessary that there be a cylindrical portion immediately adjacent the discharge end. The end of this cylindrical portion forms the discharge opening. In FIG. 2 the length of this cylindrical portion is identified as A. This length should be sufficient to give substantially laminar flow rather than turbulent flow and in this regard, it is desirable that the length of this cylindrical tip portion be at least a ratio of 1 to 3.5 with respect to its diameter or 0.28 times the diameter.

The secondary air flow has desirably little turbulence with laminar flow being desired. For this purpose, there is provided in the secondary air chamber near the outlet or discharge end of the chamber the straightening vanes 70 that extend radially outward from the coal pipe into the chamber 36.

Illustrative of the invention, satisfactory operation has been achieved when firing a kiln that is approximately 8 feet in diameter and 150 feet long for the production of primary phase mullite from either bauxite or kaolin. In firing this kiln, pulverized coal is utilized as a primary fuel approximately 98% of the time. The burner has a coal pipe that is 8 inches in diameter and a secondary air or blast pipe that is 16 inches in diameter. The coal pipe is necked down from 8 inches to 7 inches at its discharge end with the cylindrical portion of the discharge end being approximately 2 inches in axial length. The primary air stream with the pulverized coal entrained therein has a volume flow rate of approximately 5500 cubic feet per minute or 92 cubic feet per second. This, with the 7 inches discharge opening, gives a ratio of discharge area (in square feet) to volume rate of flow of the primary air (in cubic feet/second) of approximately 1 to 340. Secondary air is supplied at a rate of approximately 60,000 cubic feet per minute and the coal is pulverized to about 90% minus 200 mesh. With this kiln and firing system, the flame is well confined and is spaced about ten feet from the end of the burner and the primary phase mullite product produced is eminently satisfactory.

I claim:

1. A burner for use with a rotary kiln and having an elongated cylindrical coal pipe adapted to receive at its inlet a stream of pulverized coal and primary air for discharge from its outlet, means for supplying said coal and air to said inlet, another cylindrical pipe disposed about and coaxial with said coal pipe and of a diameter to form an annular secondary air chamber between the two pipes, a secondary air inlet to said chamber, means for supplying air to said air inlet, a plurality of gas pipes disposed in said chamber, uniformly distributed about the coal pipe and axially parallel with said coal pipe, a gas manifold, means connecting each of said pipes to the manifold, air straightening vanes mounted in the secondary air chamber near the coal pipe outlet end, and an oil gun adapted to be mounted in said coal pipe for easy insertion and removal therefrom, support means on said oil gun for positioning the same generally coaxial of the coal pipe, the ratio of the area in square feet of the coal pipe at its discharge end to volume flow rate of the primary air stream in cubic feet/sec being about 1 to 340.

* * * * *